US005373973A

United States Patent [19]

Foster

[11] Patent Number: 5,373,973

[45] Date of Patent: Dec. 20, 1994

[54] LIQUID DISPENSER ASSEMBLY WITH ADAPTOR

[75] Inventor: Donald D. Foster, St. Charles, Mo.

[73] Assignee: Contico International Inc., St. Louis, Mo.

[21] Appl. No.: 227,565

[22] Filed: Apr. 14, 1994

Related U.S. Application Data

[63] Continuation of Ser. No. 984,876, Dec. 2, 1992, abandoned, Continuation-in-part of Ser. No. 829,759, Jan. 31, 1992, abandoned.

[51] Int. Cl.[5] ..... B67D 5/42; B67D 5/46

[52] U.S. Cl. ..... 222/324; 222/382; 222/383; 222/385; 222/530

[58] Field of Search ..... 239/333; 222/179.5, 222/324, 382, 383, 385, 464, 465.1, 527, 530, 538

[56] References Cited

U.S. PATENT DOCUMENTS

| | | | |
|---|---|---|---|
| D. 275,934 | 10/1984 | Wassergord et al. | D9/376 |
| 923,447 | 6/1909 | Schmidt | 222/321 |
| 1,290,435 | 1/1919 | Watrous | 222/321 X |
| 2,117,747 | 5/1938 | Smith et al. | 222/464 X |
| 2,805,001 | 9/1957 | Biederman | 222/527 X |
| 2,818,201 | 12/1957 | Peck | 222/382 |
| 3,061,202 | 10/1962 | Tyler | 239/333 |
| 3,078,471 | 2/1963 | Knibb | 222/383 X |
| 3,190,502 | 6/1965 | Knibb | 4/519 X |
| 3,372,846 | 3/1968 | Berkus | 222/538 X |
| 4,365,751 | 12/1982 | Saito et al. | 222/383 X |
| 4,925,040 | 5/1990 | Wang | 222/538 X |
| 5,154,324 | 10/1992 | Stratford | 222/464 X |

FOREIGN PATENT DOCUMENTS

| | | | |
|---|---|---|---|
| 967529 | 5/1975 | Canada | 222/382 |
| 1027086 | 2/1978 | Canada | 222/321 |
| 843934 | 6/1952 | Germany | 222/530 |
| 917135 | 6/1961 | United Kingdom | 235/333 |

*Primary Examiner*—Andres Kashnikow
*Assistant Examiner*—Kenneth Bomberg
*Attorney, Agent, or Firm*—Rogers, Howell & Haferkamp

[57] ABSTRACT

A dispenser assembly for dispensing liquid from a container has a dispenser operable remotely from the container by way of a tube communicating the dispenser and the liquid within the container. The dispenser assembly has a hand-held dispenser and a tube connected to the dispenser for extension into the liquid within the container. The dispenser is operable to dispense liquid from the container by way of the tube. An adaptor is secured to the container with the tube operable for extending from the dispenser, through the adaptor, and into the container. With the dispenser disconnected from the adaptor and with the adaptor secured to the container, the dispenser may be operated remotely from the container to dispense the liquid from the container.

22 Claims, 7 Drawing Sheets

FIG. 2.
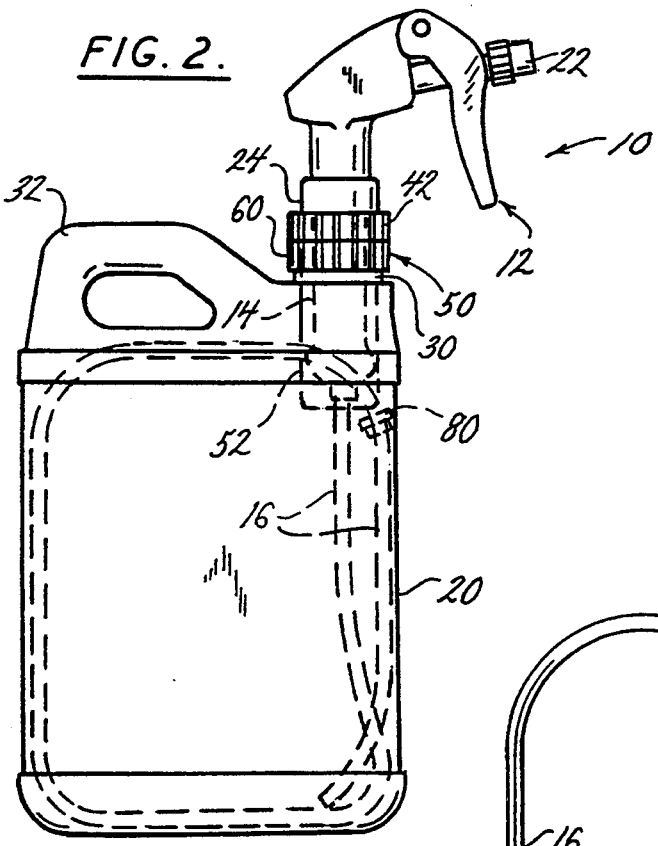
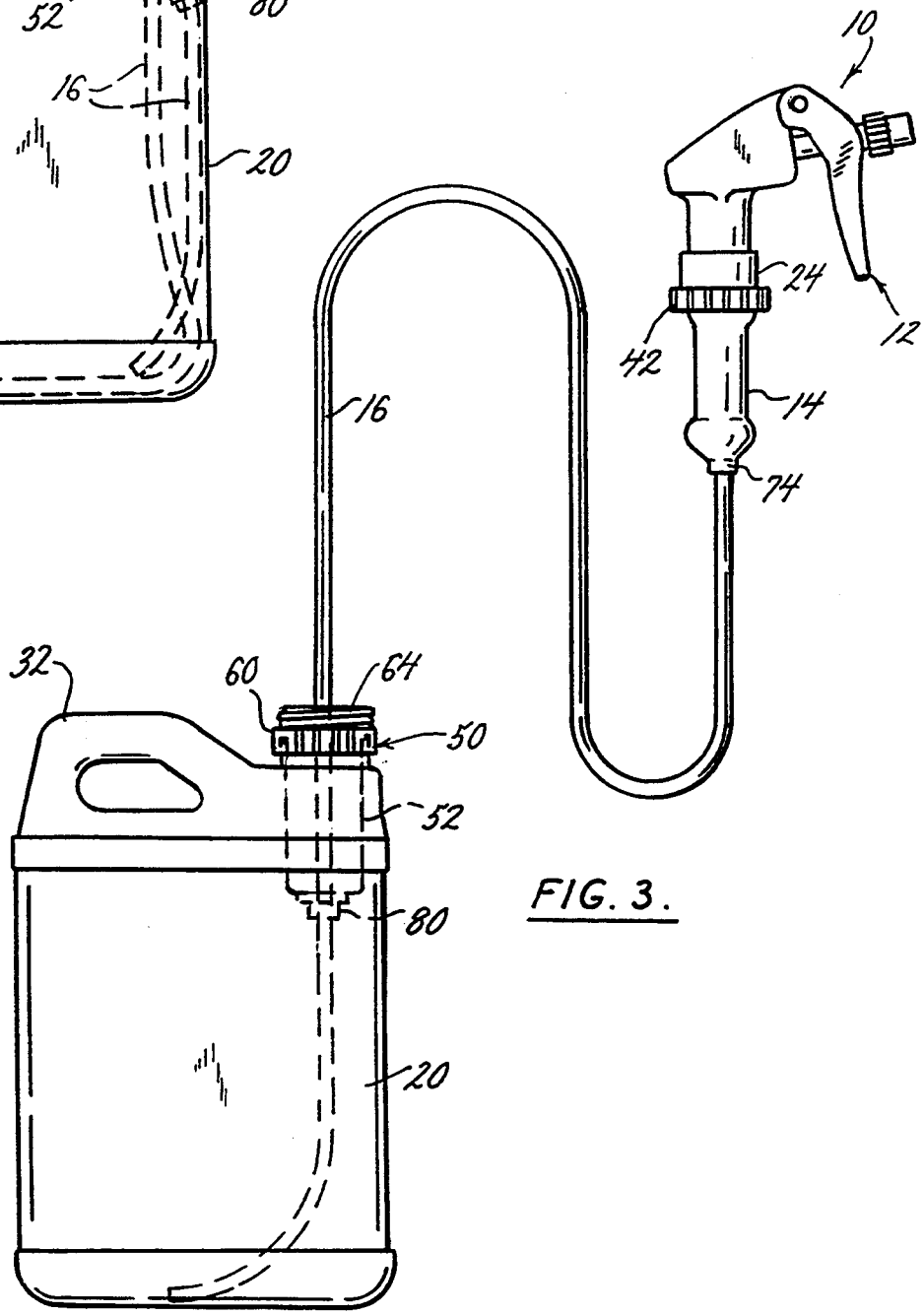
FIG. 3.

22
12
18
10
24
42
60
30
32
90
110
112
114
20
64

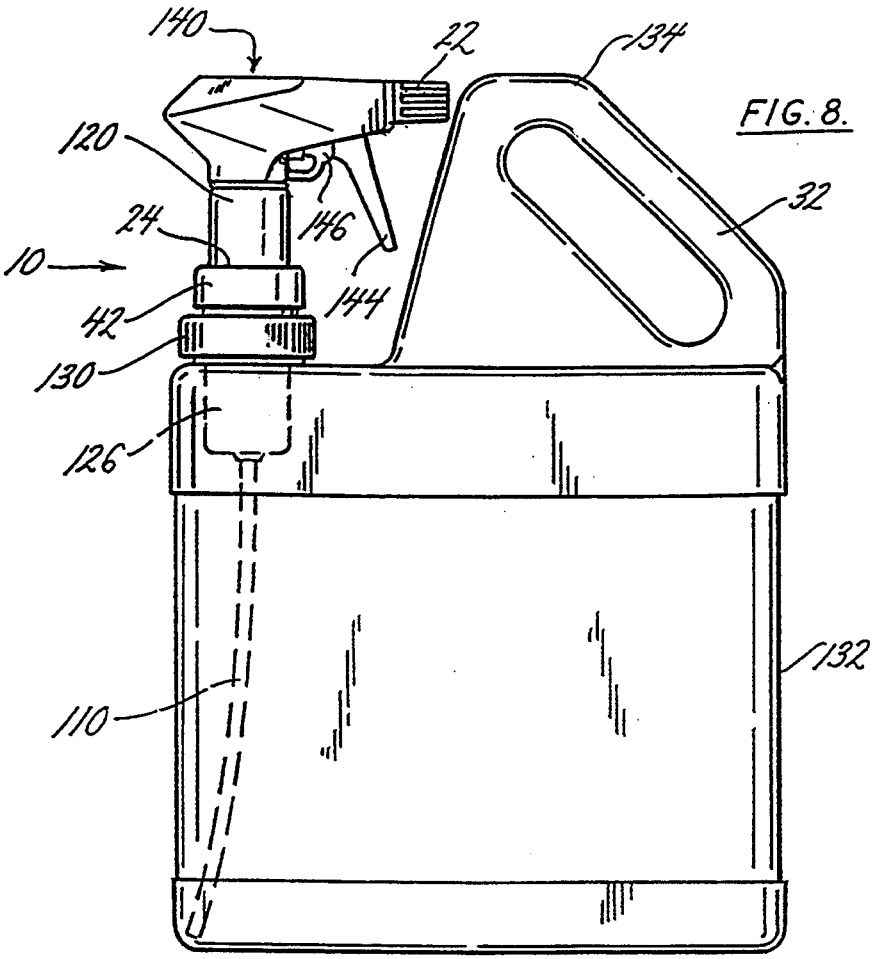
FIG. 8.
FIG. 11.
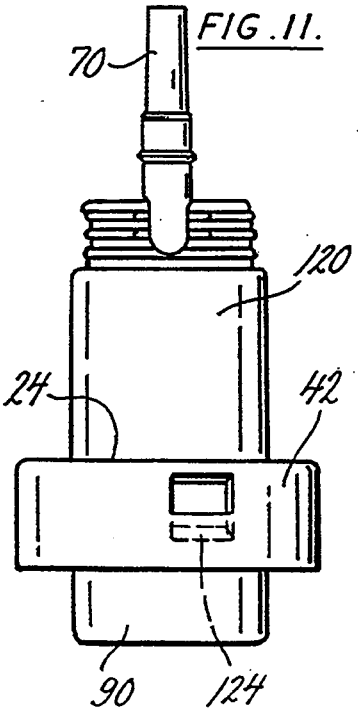
FIG. 12.
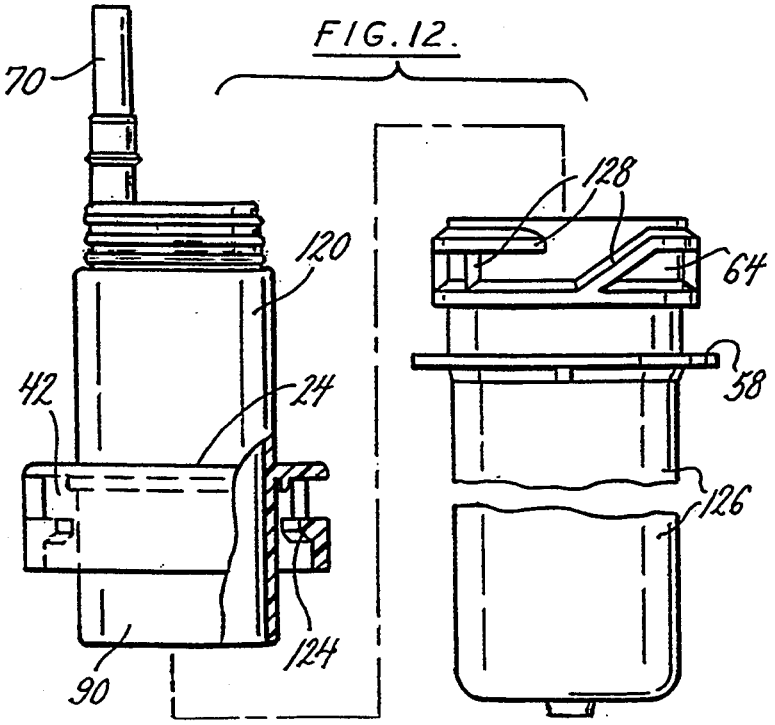

LIQUID DISPENSER ASSEMBLY WITH ADAPTOR

This is a continuation of copending application Ser. No. 07/984/876 filed on Dec. 12, 1992, now abandoned which is a continuation-in-part of U.S. Ser. No. 07/829,759, filed Jan. 31, 1993, entitled Liquid Dispenser Assembly With Adaptor, now abandoned.

BACKGROUND AND SUMMARY OF INVENTION

This invention relates to a liquid dispenser assembly, and particularly such an assembly for use with a liquid container and where the dispenser is operated remotely from the container. A tube connects the dispenser with the container for feeding the liquid to the dispenser. The present invention is an improvement over remotely operated dispensers of the type described above, and further includes a unique adaptor secured to the container and to which the dispenser may be connected for sale and storage and disconnected for remote operation.

Liquid dispenser assemblies of the type to which this invention is generally directed are well-known in the art. The dispenser assembly shown in FIG. 1 of the drawing is typical of the prior art. The dispenser assembly 10 of the prior art includes a trigger sprayer 12 having a neck portion 13, a handle portion 14 that is exposed and readily accessible for gripping by a user's hand and a tube 16. The trigger dispenser 12 is of the type well-known in the art and which is operable by means of a trigger 18 to pump liquid from a suitable container, such as container 20, and out a nozzle and orifice cap 22 of the dispenser. The cap 22 may be fixed or may be adjustable to provide a variety of spray patterns, all of which is well-known. The dispenser assembly 10 also includes a threaded closure 24 to connect the handle portion to the neck portion of the dispenser.

The container 20 is of a type typically found in retail stores and may be of plastic and have a threaded neck or rim 30 and handle portion 32 for carrying and holding the container. When the container and dispenser assembly are packaged for retail sale in the stores, the container has a threaded cap 34 with a hole 36 in the top. A gasket 38 is located between the cap and the threaded neck 30 of the bottle to seal the opening and prevent the liquid within the bottle from spilling. When packaged for sale in the store, typically the dispenser assembly, including the trigger sprayer 12, portion 14, and tube 16, are packaged in a sealed plastic bag. The bag has a hole so that the bag containing the dispenser assembly may be hung over the neck 30 of the container with the cap 34 extending through the hole. To use the prior art assembly of FIG. 1, the user removes the plastic bag from the container, and removes the dispenser assembly from the plastic bag. The user then inserts the end of the tube 16 through the hole 36 and pierces the gasket 38, thus inserting the tube into the liquid within the container. The user holds the container with one hand while operating the trigger sprayer with the other to pump the liquid from the container and out the dispenser. The container and dispenser assembly of FIG. 1 typically are used to dispense products such as insecticides, herbicides, and the like.

There are several disadvantages associated with the container and dispenser assembly of FIG. 1. Once the gasket is pierced, if the container is tipped over during use, the liquid within the container will leak between the tube and gasket and between the tube and opening 36. Another disadvantage is that the dispenser assembly is awkward to store and there is no provision for sealing the container. Still another disadvantage is that the plastic bags containing the dispenser assemblies frequently become separated from the containers in the retail store creating customer confusion and annoyance. The present invention overcomes these problems.

In accordance with the present invention, there is provided an adaptor that is secured to the neck portion of the container. While the adaptor may be disconnected from the container, it remains connected to it when sold in the stores, when in use, and when the dispenser is stored during non-use. The dispenser and adaptor have means for connecting the dispenser and adaptor together with the tube extending from the dispenser, through the adaptor, and into the container. The dispenser may be disconnected from the adaptor while the adaptor remains secured to the container, for operation of the dispenser remotely from the container. The tube extends through the adaptor in sealing engagement therewith to prevent liquid from entering the interior of the adaptor. Thus, the interior of the adaptor remains dry and sealed from the liquid. When the dispenser assembly is connected to the adaptor, the handle portion of the dispenser extends into the interior of the adaptor and remains dry and out of contact with the liquid. In use where the dispenser is disconnected from the adaptor and operated remotely, the adaptor remains secured to the container to provide a seal against spilling.

In one preferred embodiment of the invention, the adaptor has a chamber therein. The tube has a preformed coil portion housed within the chamber with the dispenser and adaptor connected. The coil portion extends upon disconnecting the dispenser from the adaptor for remote operation of the dispenser. This embodiment has the advantage that the exterior surface of the preformed coiled tube portion which may come in contact with the user during use, is protected from the liquid, it being housed within the adaptor chamber.

These and other advantages of the invention are apparent from the drawing and detailed description to follow.

DESCRIPTION OF THE DRAWINGS

FIG. 2 is a side elevational view of a liquid dispenser assembly with adaptor of the present invention shown with the dispenser assembly connected to the adaptor for sale in the stores or storage.

FIG. 3 shows the dispenser assembly of FIG. 2 but with the dispenser assembly disconnected from the adaptor for use by remote operation of the dispenser assembly.

FIG. 8 is a view similar to FIGS. 2 and 5 but showing still another preferred embodiment of the present invention.

FIG. 11 is a front elevation view of the valve case of FIG. 9.

FIG. 12 is an exploded view, showing a side elevation of the valve case in partial section and showing the adaptor partly broken away.

DETAILED DESCRIPTION OF PREFERRED EMBODIMENTS

Figure 1:
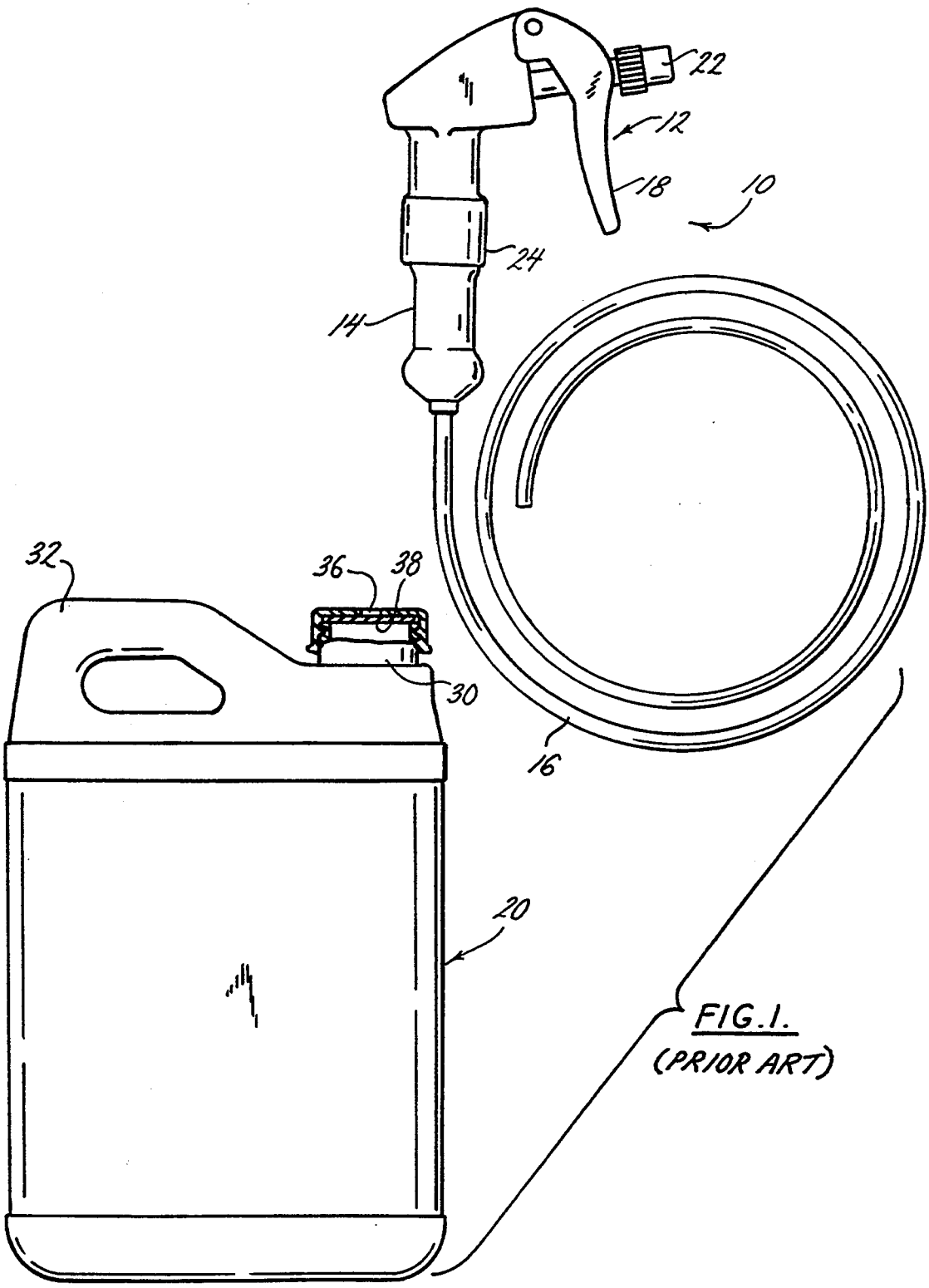
FIG. 1. (PRIOR ART)
FIG. 1 shows a dispenser assembly and container of the prior art.
Figure 4:
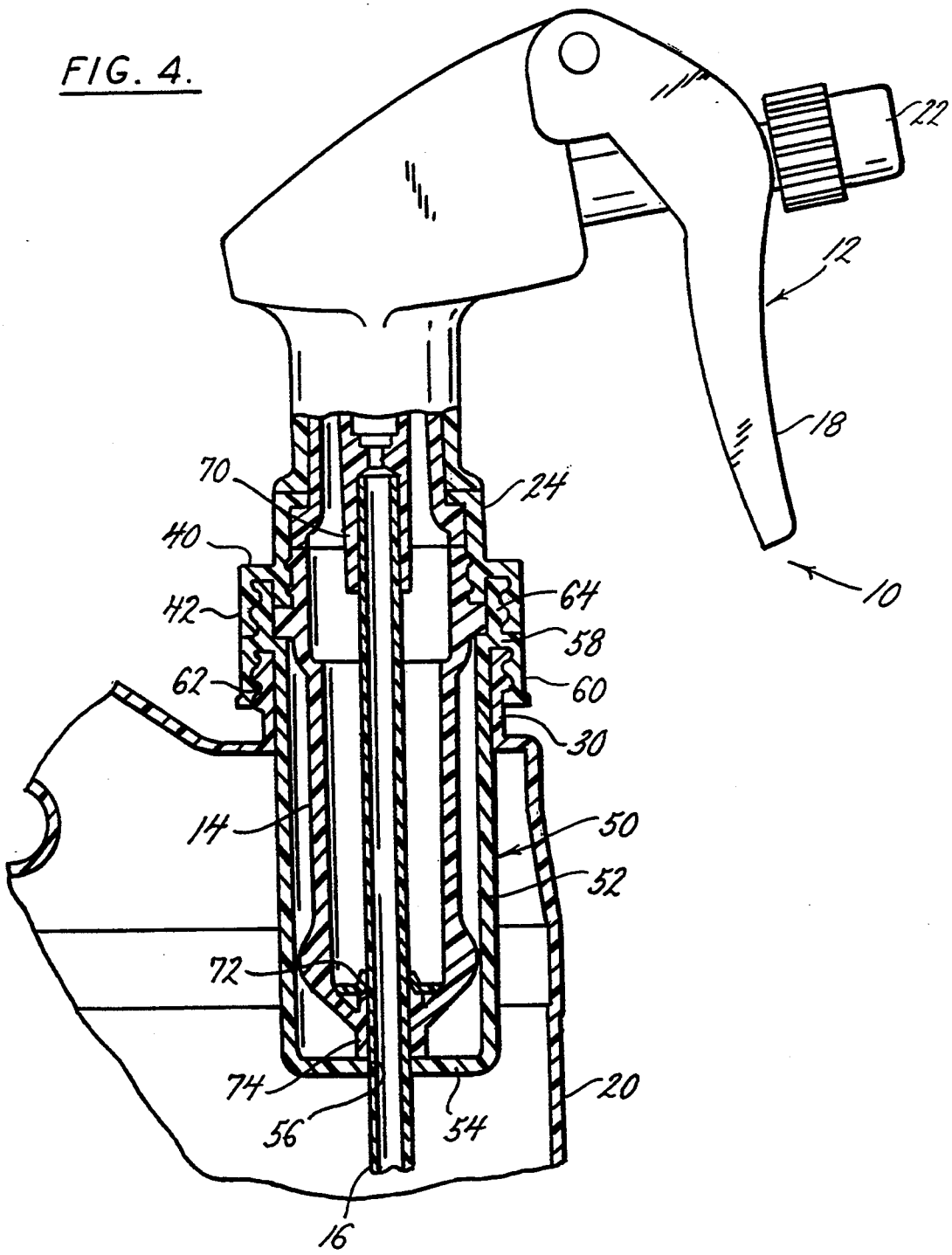
FIG. 4 is a view in partial section of the dispenser assembly and adaptor of FIG. 2 shown with the dispenser assembly connected to the adaptor.

With reference to the drawing, one preferred embodiment of the liquid dispenser assembly with adaptor of the present invention is shown in FIGS. 2–4. Generally, the dispenser assembly is the same as shown in FIG. 1 except that the closure 24 has an outwardly extending shoulder 40 and an internally threaded ring portion 42 depending therefrom. The container 20 is also the same but does not include the cap 34 or gasket 38 as these are not used with the present invention. An adaptor 50 is generally cup-shaped and has a cylindrical tubular portion 52 and a bottom 54 with a central opening 56 therethrough. At the top of the cylindrical portion 52 is a shoulder 58 with a ring portion 60 depending therefrom. The ring portion 60 has internal threads 62 that mate with the threaded neck 30 of the container. The internal threads 62 of the ring portion 60 and the external threads of the threaded neck 30 serve as connectors for releasably affixing, meaning releasably physically connecting, the adaptor 50 to the container 20. Extending upwardly from the shoulder 58 is an externally threaded ring 64. The threads of the ring 64 mate with those of the threaded ring 42 of closure 24 of the dispenser assembly. The external threads of the ring 64 and the internal threads of the ring 42 serve as connectors for releasably affixing, meaning releasably physically connecting, the adaptor 50 to the liquid dispenser assembly 10.

The tube 16 is connected within the neck and handle portions of the dispenser. The upper end of the tube is connected to a fitting 70 such that liquid pumped through the tube is fed through suitable passages within the trigger dispenser as is well-known in the art. The tube is further supported at the lower end of the handle portion by means of a bracket 72 and an extended cylindrical portion 74 to provide sealing engagement between the tube and the lower end of the handle portion. The tube 16 fits within the opening 56 at the bottom of the adaptor. The opening is somewhat undersized to provide a tight-fit engagement while allowing the tube to be pushed and pulled through the opening. The tube is preferably of plastic and is flexible and somewhat forgiving to allow the tube to be pushed and pulled through the opening and yet provide a liquid-tight seal.

The dispenser assembly and container of FIGS. 2–4 are sold in the retail stores with the adaptor secured to the container and with the dispenser assembly connected to the adaptor as shown in FIGS. 2 and 4. There is little or no likelihood of the dispenser assembly becoming inadvertently separated from the container as frequently occurred with the prior art arrangement.

To use the dispenser assembly, the dispenser assembly is disconnected from the adaptor, leaving the adaptor secured to the container. The tube is pulled from the container through the opening 56 while leaving a sufficient length of tube extending into the liquid as shown in FIG. 3. Typically, the user operates the dispenser assembly by holding the container in one hand while remotely operating the dispenser with the other to pump liquid from the container and through the nozzle and cap 22 of the dispenser. Preferably, a retainer clip 80 is secured to the tube to act as a stop so that the user does not inadvertently pull all of the tube from the container, but instead leaves a sufficient length of tube within the liquid as shown in FIG. 3.

To store the dispenser assembly and container after use, the tube is pushed back through the opening 56 and into the container, and the dispenser assembly is again connected to the adaptor by screwing the closure 24 onto the threaded ring 64 of the adaptor. The assembly is sealed against leakage both while in use and storage.

Figures 5, 6:
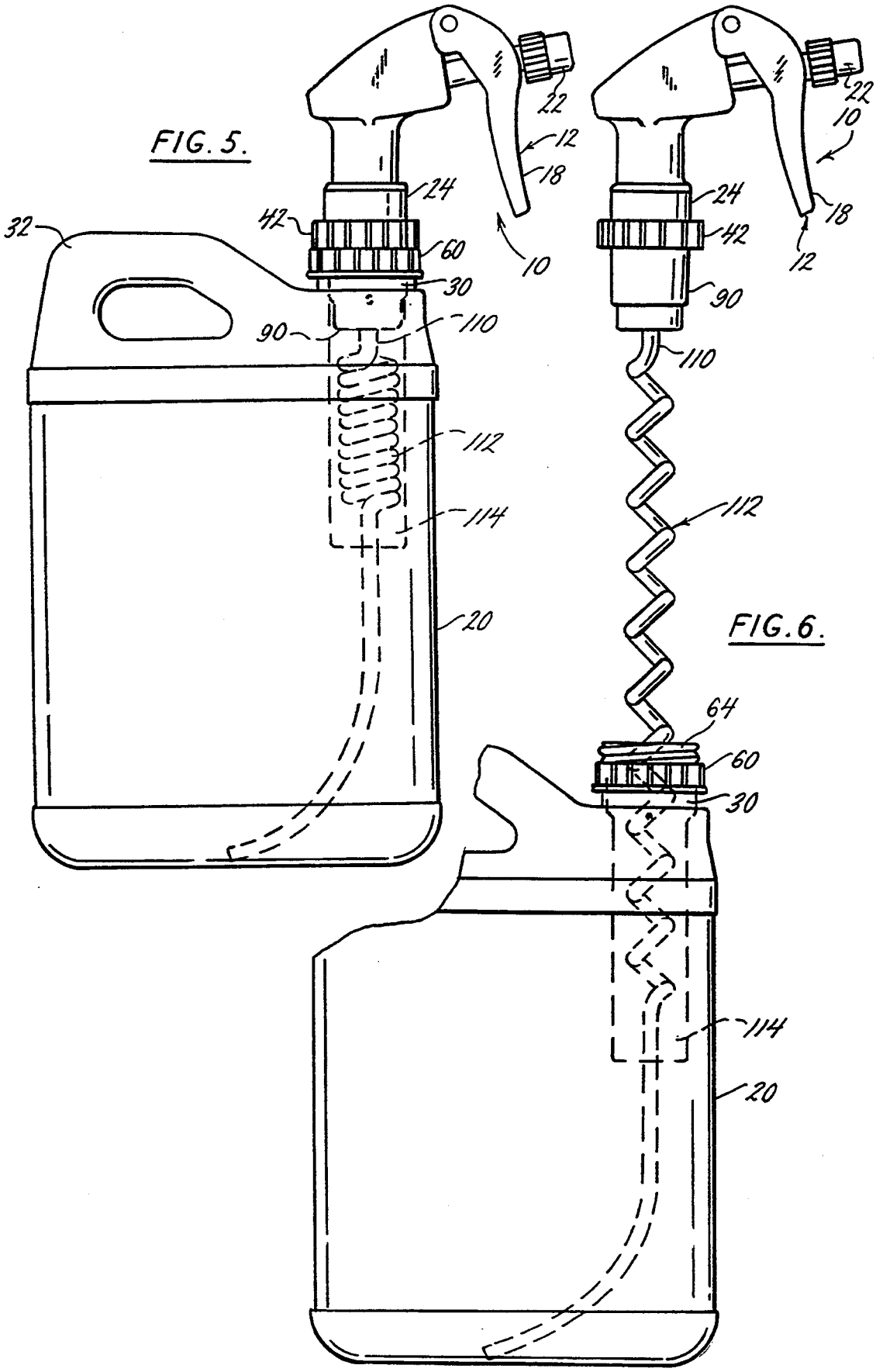
FIG. 5 is a view similar to FIG. 2 but showing another preferred embodiment of the invention.
FIG. 6 is a view showing the embodiment of FIG. 5 but with the dispenser assembly disconnected from the adaptor for use by remote operation of the dispenser.
Figure 7:
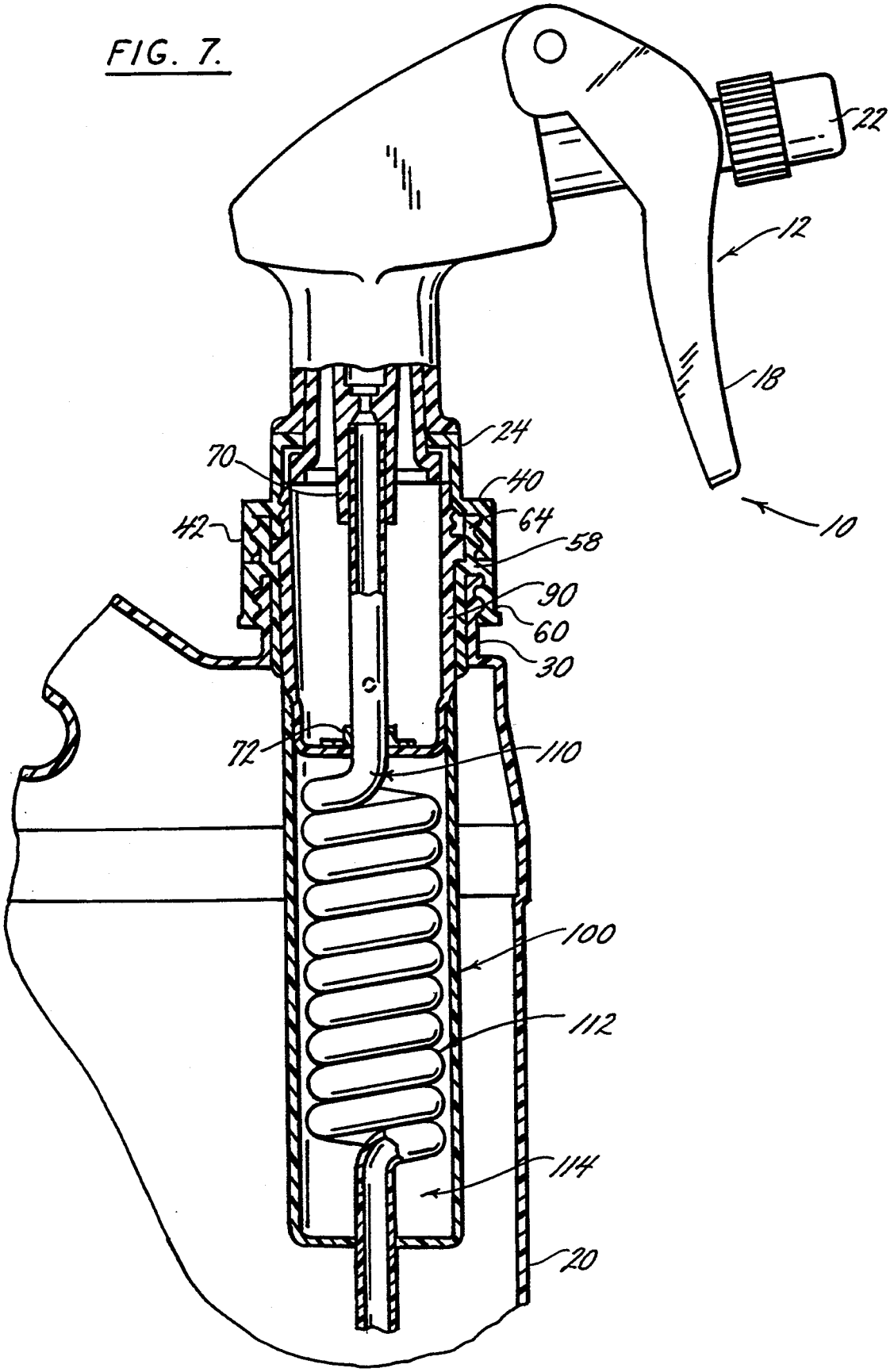
FIG. 7 is a view in partial section of the dispenser assembly and adaptor of FIG. 5.

Another preferred embodiment of the invention is shown in FIGS. 5–7. This embodiment is the same as the one shown in FIGS. 2–4 except as will be explained.

The sprayer assembly of this embodiment also has a handle portion 90 similar to the handle portion 14 of the embodiment of FIGS. 2–4, but is somewhat shorter. The dispenser assembly of this embodiment also has an adaptor 100 similar to the adaptor 50 of the previous embodiment but is substantially longer. The dispenser assembly of this embodiment also has a tube 110 similar to the tube 16 of the previous embodiment except that it has a preformed coil portion 112 housed within a chamber 114 within the adaptor, the chamber being defined within the adaptor beneath the handle portion 90 of the dispenser. The upper end of the tube extends into the handle and neck portions of the dispenser and is secured thereto as with the first described embodiment. Also as with the first described embodiment, the tube extends in a tight-fit engagement through an opening at the bottom of the adaptor.

The operation and use of the dispenser assembly and adaptor of this embodiment is similar to that of the first described embodiment, except that when the dispenser assembly is disconnected from the adaptor for remote operation of the dispenser, the preformed coil portion 112 of the tube extends as shown in FIG. 6, rather than the tube being pulled through the opening at the bottom of the adaptor as with the first described embodiment. To place the dispenser assembly back in its stored position, the preformed coil portion is allowed to collapse as in FIGS. 5 and 7 to be housed in the chamber 114 with the dispenser assembly connected to the adaptor. The primary advantage of this embodiment is that the lower portion of the tube in contact with the liquid is never pulled from the container where it might contact the user, and the portions of the tube that are contacted by the user always remain segregated from the liquid.

Still another preferred embodiment of the present invention is shown in FIGS. 8–12. Generally, this embodiment is the same as the one shown in FIGS. 5–7 except as will be explained.

The dispenser assembly of this embodiment has a valve case 120 which is integrally molded as one-piece, and which performs the functions of the handle portion 90, the threaded closure 24, and the fitting 70 of Figure 7. The valve case 120 includes an inverted-cup shaped portion 121 that defines a central cavity 122. The ring portion 42 of this valve case 120, as better shown in FIGS. 11 and 12, is formed with opposite inwardly projecting tabs 124.

The dispenser assembly of this embodiment also has an adaptor 126 similar to the adaptor 100 of FIG. 7 except that the adaptor 126 is shorter, and the shoulder 58 does not include the depending ring portion 60. As better shown in FIG. 12, the adaptor 126 has the top portion 64 formed with bayonet-type provisions 128 which mate with the tabs 124 of the valve case 120. The adaptor 126 includes a collar 130 that is rotatably mounted on the shoulder 58 and has internal threads that mate with the threaded neck 30 of the container. The adaptor 126 has a vent 131.

This embodiment of the present invention includes a container 132 similar to the container 20 of FIGS. 1–7 except that this container 132 has a crown portion 134 that extends at least to the top of the dispensing assembly, as shown in FIG. 8, and preferably somewhat above the top. Also, the container 132 has the handle portion 32 sloped as shown in FIG. 8. The container 132 is provided with the sloping handle portion 32 so that when the container is carried and liquid is in the container, the liquid will settle in the opposite bottom corner where the inlet to the dip tube 110 is located. This insures that during use, while the container is held in one hand and the sprayer in the other, the inlet to the dip tube 110 will be below the liquid level, even when the liquid level is drawn low. The crown portion 134 extends as high as or higher than the top of the dispensing head 140 to act as protection during shipment, storage, and the like. The crown portion 134 is located toward the vertical center of the container so that the container and its liquid contents will balance it upside down.

The dispensing assembly of this embodiment has a dispensing head 140. Both the dispensing head 140 and the trigger dispenser 12 are well-known in the art. Although the dispensing head 140 is more particularly shown here, it is merely representative of pump sprayers in general, and it is to be understood that there are many variations of dispensers that may be used with this invention, dispensers 12 and 140 being only examples.

The dispensing head 140 is an operable assembly which includes a housing 142, a trigger 144, a plunger 146, a spring 148, a spinner assembly 150, and the nozzle and orifice cap 22. The housing 142 is a molded piece that defines several chambers, including a vertical chamber 152, a horizontal chamber 154, a piston chamber 156 and a vent chamber 158 reciprocally receiving a vent piston 160. The wall of the vent chamber has a vent opening 162 which (with the vent opening 131) vents the container when the vent piston is retracted (moves to the left as viewed in FIG. 9) upon pulling the trigger 144. The fitting end 70 of the valve case 120 is press fitted into the vertical chamber 152. The trigger 144 has its upper end pivotally supported by the housing 142 by means of oppositely extending lugs (not shown, but which extend into and out of the view of FIG. 9) which pivot within recesses in spaced side panels of the housing 142. Manually operating the trigger 144 causes the pumping of liquid through the tube from the container for ejection out the nozzle and orifice cap 22, as is well-known in the art.

With the bayonet-type connection between the valve case 120 and the adaptor 126, the valve case 120 can either be snapped directly onto the adaptor 126, or connected by orienting the dispensing head 140 at 90° to the container crown 134 and then rotating the dispensing head 140 a quarter turn until the dispensing head 140 is aligned with the container crown 134 as shown in Figure 8. The dispensing head 140 is mounted to the container 132 in the proper orientation by virtue of the adjustability provided by the collar 130. Thereafter, the dispensing head 140 is connected and disconnected to the adaptor 126 by means of the bayonet connection so that the dispensing head 140 is easily oriented to the same position for storage. The bayonet provisions 128 of the adaptor 126 and the threads of the collar 130 tighten in opposite directions so that rotation of the tabs 124 to disconnect the dispensing head 140 tends to tighten the collar 130 onto the threaded neck 30. The collar 130 and neck 30 may also be adapted to be connected with bayonet type provisions, but preferably at least the valve case 120 and adaptor 126 connect by bayonet type connections for ease and orienting the dispensing head 140.

Figure 9:
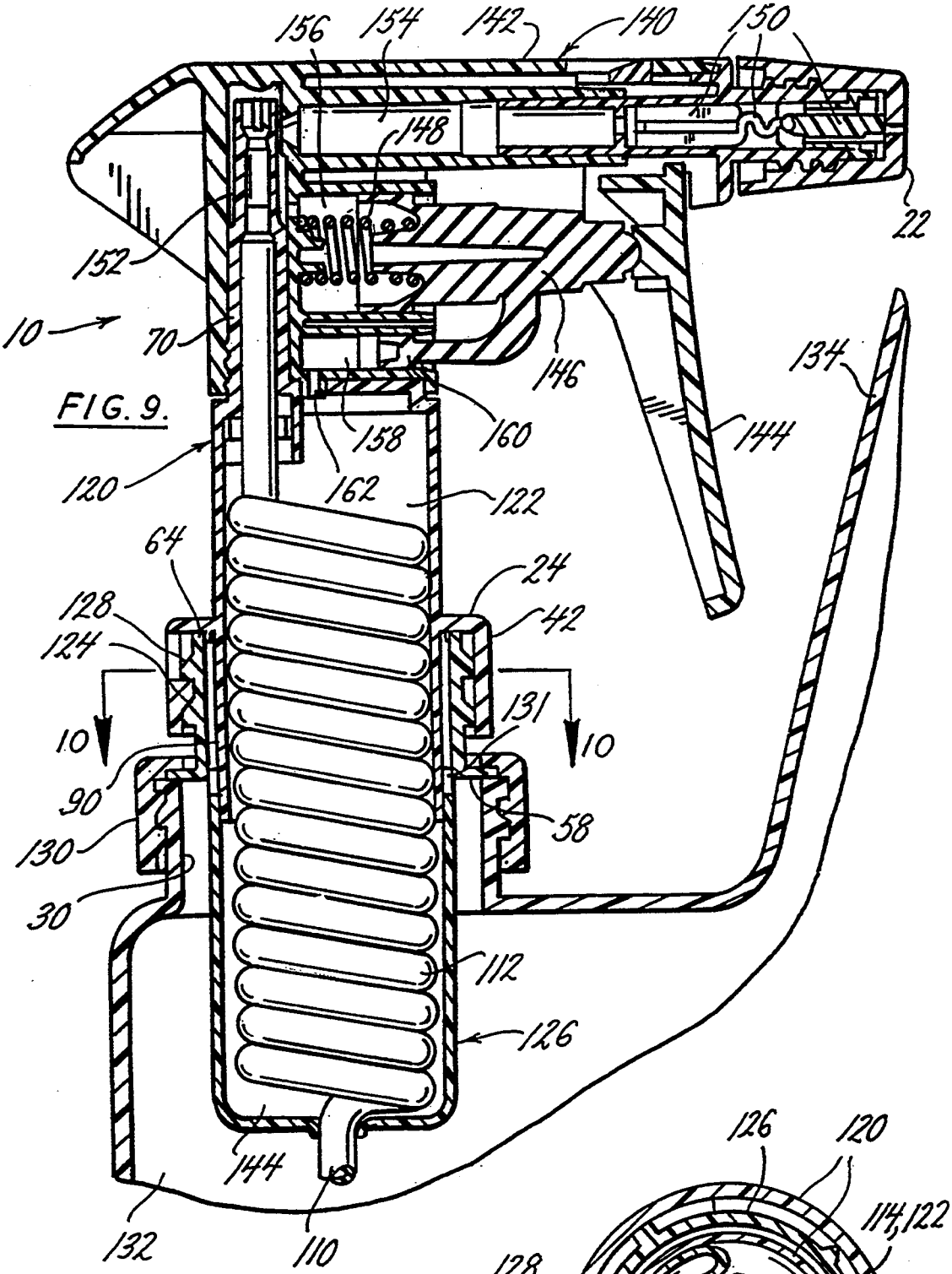
FIG. 9 is a view in partial section of the dispenser assembly and adaptor of FIG. 8.
Figure 10:
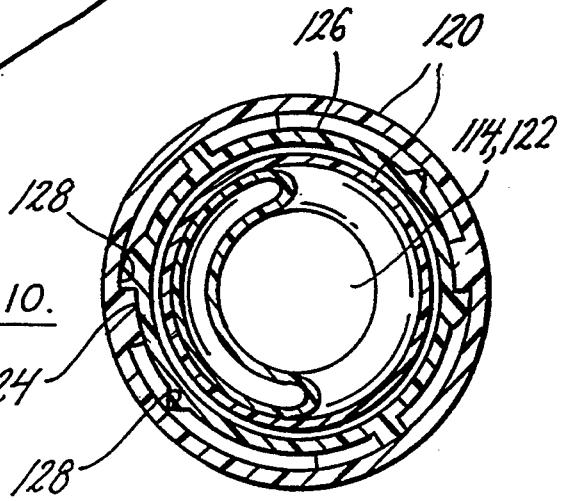
FIG. 10 is a section view taken along the line 10—10 of FIG. 9.

The operation and use of the dispenser assembly and adaptor 126 of FIGS. 8–12 are similar to that of the embodiment of FIGS. 5–7, except that the cavity 122 of the valve case 120 cooperates with the chamber 114 of the adaptor 126 for housing the preformed coils 112 of the tube, as shown in FIGS. 9 and 10.

While the present invention has been described by reference to specific embodiments, it should be understood that modifications and variations of the invention may be constructed without departing from the scope of the invention defined in the following claims.

What is claimed is:

1. An assembly for dispensing liquid from a container liquid within an interior of the container; the container having opening in the container, the opening providing access to the container interior, the assembly comprising:

a conduit having a length that enables extension of the conduit into the liquid held within the container interior;

a hand-held dispenser connected to the conduit, the hand-held dispenser having a pump operable for drawing liquid from the container interior by way of the conduit when the conduit is extended into the liquid held in a container interior; and an adaptor having a configuration dimensioned to enable insertion of the adaptor through the container opening and into the interior of the container and having a connector for affixing the adaptor on the container with the adaptor inserted through the container opening;

the dispenser and adaptor having connectors releasably affixing the dispenser on the adaptor and the conduit extending from the dispenser sealingly through the adaptor and into the container with the adaptor inserted through the container opening; the conduit having flexible portions that provide extension upon disconnecting the dispenser from the adaptor for remote operation of the dispenser from the adaptor.

2. The assembly of claim 1 wherein:

the dispenser is a trigger dispenser that includes a handle portion that is readily accessible for gripping of the handle portion by a person's hand.

3. The assembly of claim 2 wherein:

the adaptor has a tubular portion with a hollow interior, and the handle portion of the dispenser extends at least partially into the interior of the tubular portion of the adaptor with the dispenser affixed on the container adaptor.

4. The assembly of claim 3 wherein:

the tubular portion of the adaptor and handle portion of the dispenser extend at least partially into the container when the adaptor is inserted into the container opening and is affixed on the container and the dispenser is affixed on the adaptor.

5. The assembly of claim 2 wherein:

the adaptor has a chamber therein, and the conduit has a preformed coil portion housed within the chamber with the dispenser affixed to the adaptor; the coil portion extending upon disconnecting the dispenser from the adaptor for remote operation of the dispenser.

6. The assembly of claim 1 wherein:

the hand-held dispenser has a handle portion, and the handle portion has a chamber therein, the conduit has a preformed coil portion, and the adaptor has a chamber therein that cooperates with the chamber of the handle portion for housing the preformed coil portion with the dispenser affixed to the adaptor; the coil portion extending upon disconnecting the dispenser from the adaptor for remote operation of the dispenser.

7. The assembly of claim 1 wherein:

the dispenser and adaptor connectors include interengaging bayonet connectors.

8. The assembly of claim 1 wherein the conduit has a retainer for preventing complete removal of the conduit from the adaptor.

9. The assembly of claim 1 wherein: the adaptor connector for affixing the adaptor on the container when the adaptor is inserted into the container opening includes threaded connectors on the adaptor.

10. The assembly of claim 1 wherein:

the dispenser and adaptor connector include threaded connectors.

11. A dispensing system comprising:

a container for holding a liquid within an interior of the container, the container having an opening to the container interior;

an adaptor inserted through the container opening and into the container interior and the adaptor and container having connectors releasably affixing the adaptor to the container with the adaptor inserted through the container opening and into the container interior;

a conduit extending sealingly through the adaptor and into the container interior with the adaptor connected to the container for conducting liquid out of the container and through the adaptor; and a hand-held dispenser connected to the conduit, the dispenser having a pump for drawing liquid from the container by way of the conduit;

the dispenser and adaptor having connectors releasably affixing the dispenser and adaptor together with the conduit extending from the dispenser to the adaptor, and into the container; the conduit having flexible portions that provide extension upon disconnecting the dispenser from the adaptor for remote operation of the dispenser.

12. The dispensing system of claim 11 wherein:

the connectors connecting the dispenser and adaptor are interengaging threaded connectors.

13. The dispensing system of claim 11 wherein:

the connectors for connecting the dispenser and adaptor are interengaging bayonet connectors.

14. The dispensing system of claim 11 wherein:

the adaptor has a chamber therein, and the flexible portions of the conduit include a preformed coil portion which can be housed within the chamber while the dispenser is connected to the adaptor.

15. The dispensing system of claim 11, wherein:

the container has a configuration that positions the container opening in a horizontal plane when the container rests upon a flat, horizontal surface and the container has a handle having a center axis positioned at an angle relative to a plane of the container opening, whereby when the container is suspended by the handle with the handle axis positioned in a horizontal plane, the plane of the container opening is positioned at an angle relative to the horizontal plane.

16. An assembly for dispensing a liquid from a container, said dispensed assembly comprising:

a dispensing head;

a handle attached to the dispensing head, the handle being configured for gripping by a user's hand and having an open-ended, cylindrical chamber therein:

a flexible conduit extending from the dispensing head through the chamber and having a length that enables insertion of the conduit into liquid of the container for delivering the liquid from the container to the dispensing head, at least a portion of the flexible conduit being housed in the handle chamber; and said portion of said flexible conduit being flexibly extendable from the handle chamber; and a connector attached to the handle releasably affixing the dispenser head to an adaptor, the connector located on the handle so that the handle extends at least partially into the adaptor when the dispenser head is connected to the container.

17. The assembly of claim 16 wherein:

the connector includes provisions of a bayonet type connection.

18. The assembly of claim 16, further comprising:

an adaptor having a configuration dimensioned to enable insertion of the adaptor through an opening of the container and into an interior volume of the container, the adaptor having a hollow interior with an opening thereto, the adaptor interior being dimensioned to house a portion of the flexible conduit therein.

19. The assembly of claim 18, wherein:

the handle of the dispensing head and the adaptor are configured to be connected together with the handle chamber and adaptor interior communicating and housing a portion of the conduit therein.

20. A container adaptor for connecting a container to a hand-held pump dispenser having a conduit, where the container has an interior holding a liquid and an opening to the interior, and the dispenser has a handle that is accessible on the dispenser for gripping of the handle by a person's hand, the container adaptor comprising:

at least one wall having a cup-shaped configuration defining an interior chamber within the cup-shaped wall and a first opening in the wall providing access to the interior chamber and a second opening in the wall for insertion of the conduit therethrough, the second opening providing a seal for the conduit, the interior chamber having a volume sufficiently large to receive therein the dispenser handle when inserted through the first wall opening, the cup-shaped wall having first means positioned around the first opening in the wall for releasably affixing the wall to the dispenser when the dispenser handle is inserted through the first wall opening and is received in the interior chamber, and the wall having an exterior configured for insertion of the cup-shaped wall through the container opening and into the container interior, the wall having second means positioned on the wall exterior for releasably affixing the wall to the container when the wall is inserted through the container opening and into the container interior.

21. The container adaptor of claim 20, wherein:

the second means for releasably affixing the wall to the container is a threaded connector.

22. The container adaptor of claim 20 wherein:

a flange extends outwardly from the wall exterior and the second means for releasably affixing the wall to the container includes a threaded collar mounted for rotation on the wall and the flange.

* * * * *

UNITED STATES PATENT AND TRADEMARK OFFICE

CERTIFICATE OF CORRECTION

PATENT NO. : 5,373,973
DATED : December 20, 1994
INVENTOR(S) : Donald D. Foster

It is certified that error appears in the above-indentified patent and that said Letters Patent is hereby corrected as shown below:

In column 6, at line 29, insert --holding-- after "container"; at line 31, insert --an-- after "having"; and at line 66, delete "container".

In column 7, at line 34, replace "connector" with --connectors--; and at line 64, delete "for".

In column 8, at line 15, delete "dispensed", and at line 39, replace "an" with --the--.

Signed and Sealed this

Thirty-first Day of October 1995

*Attest:*

*Attesting Officer*

Bruce Lehman

BRUCE LEHMAN

*Commissioner of Patents and Trademarks*